US007683837B2

(12) United States Patent
Noro

(10) Patent No.: US 7,683,837 B2
(45) Date of Patent: Mar. 23, 2010

(54) PATCH ANTENNA

(75) Inventor: Junichi Noro, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 218 days.

(21) Appl. No.: 11/829,281

(22) Filed: Jul. 27, 2007

(65) Prior Publication Data

US 2008/0055161 A1 Mar. 6, 2008

(30) Foreign Application Priority Data

Sep. 6, 2006 (JP) ..... 2006-241706

(51) Int. Cl.
*H01Q 1/38* (2006.01)

(52) U.S. Cl. ..... 343/700 MS; 343/702; 343/846; 343/895

(58) Field of Classification Search ..... 343/711, 343/713, 833, 834, 846, 848, 700 MS, 702, 343/895
See application file for complete search history.

(56) References Cited

U.S. PATENT DOCUMENTS 6,879,292 B2 * 4/2005 Shikata et al. ..... 343/700 MS
7,009,563 B2 * 3/2006 Mori et al. ..... 343/700 MS
7,042,399 B2 * 5/2006 Noro et al. ..... 343/700 MS
7,079,078 B2 * 7/2006 Yuanzhu ..... 343/700 MS
7,126,539 B2 * 10/2006 Li et al. ..... 343/700 MS
7,132,988 B2 * 11/2006 Yegin et al. ..... 343/727
7,253,770 B2 * 8/2007 Yegin et al. ..... 343/700 MS
2008/0122697 A1 * 5/2008 Mierke et al. ..... 343/700 MS

FOREIGN PATENT DOCUMENTS

JP 2005-110198 4/2005
JP 2005-260875 9/2005

* cited by examiner

*Primary Examiner*—Douglas W Owens
*Assistant Examiner*—Chuc D Tran
(74) *Attorney, Agent, or Firm*—Whitham Curtis Christofferson & Cook, PC

(57) ABSTRACT

A dielectric substrate has a first face which is formed with a cavity, and a second face opposite to the first face. The dielectric substrate formed with a substrate hole which connects the cavity and the second face. An antenna radiation electrode is comprised of a conductive film and is formed on the first face of the dielectric substrate. A ground electrode is comprised of a conductive film, is formed on the second face of the dielectric substrate and is formed with a ground hole which is substantially concentric with the substrate hole and has a diameter larger than that of the substrate hole. One end of a feeding pin is connected to the antenna radiation electrode and the other end of the feeding pin is extended toward the second face of the dielectric substrate through the substrate hole and the ground hole.

18 Claims, 5 Drawing Sheets

PATCH ANTENNA

The disclosure of Japanese Patent Application No. 2006-241706 filed Sep. 6, 2006 including specification, drawings and claims is incorporated herein by reference in its entirety.

BACKGROUND

The present invention relates to a patch antenna, and more particularly, to a patch antenna suitable for an antenna mounted on a transportable electronic device and an antenna mounted on a vehicle such as an automobile.

Currently, various antennas are mounted on a vehicle such as an automobile. Such an antenna, for example, an antenna for GPS (Global Positioning System) or an antenna for SDARS (satellite digital audio radio service) is used.

The GPS is a satellite positioning system using artificial satellites. In the GPS system, electric waves (GPS signal) are received from four artificial satellites (hereinafter, referred to as "GPS satellite") among twenty four GPS satellites orbiting around the earth, a positional relation and a time error between a mobile object and the GPS satellites are measured on the basis of the received electric waves, and a position or an altitude of the mobile object on a map is high precisely calculated on the basis of triangulation.

Recently, the GPS is used for a car navigation system detecting a position of a traveling automobile and comes into wide use. The car navigation device includes a GPS antenna for receiving a GPS signal, a processor for detecting a present position of a vehicle by processing the GPS signal received by the GPS antenna, a display for displaying the position detected by the processor on a map, and the like. A planar antenna such as a patch antenna is used as the GPS antenna.

The SDARS (Satellite Digital Audio Radio Service) is a digital broadcasting service using a satellite (hereinafter, referred to as "SDARS satellite") in the United States. That is, in the United States, a digital radio receiver receiving a satellite wave or a terrestrial wave from the SDARS satellite to provide digital radio broadcasting has been developed and put in practical use. Currently, in the United States, two broadcasting stations of XM and Sirius have provided radio programs more than total 250 channels throughout the whole country. The digital radio receiver is generally mounted in a mobile object such as an automobile, receives the electric wave in the frequency band of about 2.3 GHz, and provides the radio broadcasting. That is, the digital radio receiver is a radio receiver capable of providing the mobile broadcasting. Since the frequency of the reception electric wave is about 2.3 GHz, the reception wavelength (resonance wavelength) $\lambda$ at that time is about 128.3 mm. The terrestrial wave is formed in the manner that the satellite wave is received by an earth station, the frequency of the received satellite wave is slightly shifted, and the wave is re-sent in a linearly-polarized wave. That is, the satellite wave is a circular-polarized wave, but the terrestrial wave is the linearly-polarized wave. In addition, the planar antenna such as the patch antenna is used as the SDARS antenna in the same manner as the GPS antenna.

The antenna device for XM satellite radio receives the circular-polarized electric wave from two geostationary satellites, and receives the electric wave by using terrestrial linear-polarized equipments in a blind zone. On the other hand, the antenna device for Sirius satellite radio receives the circular-polarized electric wave from three orbiting satellites (synchro type), and receives the electric wave by the use of the terrestrial linear-polarized equipments in the blind zone.

Since the electric wave in the frequency band of about 2.3 GHz is used in such digital radio broadcasting, an antenna device receiving the electric wave is required to be installed outdoors. As a digital radio receiver, there are a receiver built in a vehicle, a receiver mounted on a roof, and a transportable receiver which has a battery as a power supply.

The transportable digital radio receiver is built in a transportable electronic device such as a transportable acoustic device. In addition to a digital tuner for receiving the digital radio broadcasting, for example, a optical disk drive for reproducing an optical disk such as a compact disk (CD), a lamp, a speaker are integrally built in a case of the transportable digital device. In the transportable electronic device, it was proposed that a patch antenna is built in an openable-closable door-type cover for inserting or removing the optical disk (e.g., see Japanese Patent Publication No. 2005-110198A).

The related-art first patch antenna 10 will be described with reference to FIGS. 1 to 3. FIG. 1 is a perspective view of the related-art patch antenna 10. FIG. 2(A) is a plane view of the patch antenna 10, FIG. 2(B) is a front view of the patch antenna 10, FIG. 2(C) is a left side view of the patch antenna 10, and FIG. 2(D) is a bottom view of the patch antenna 10. FIG. 3 is a cross-sectional view taken along Line III-III in FIG. 2(A).

The patch antenna 10 includes a dielectric substrate 12 having a substantially rectangular parallelepiped shape, an antenna radiation electrode (radiation element) 14, a ground electrode (ground conductor) 16, and a rod-shaped feeding pin 18.

For example, ceramic materials with high permittivity made of barium titanate are used for the dielectric substrate 12. The dielectric substrate 12 has a top surface (front surface) 12*u*, a bottom surface (back surface) 12*d*, side surfaces 12*s*. In the example in the figures, the corners of the side surfaces 12*s* of the dielectric substrate 12 are chamfered. In the dielectric substrate 12, a substrate hole 12*a* penetrating from the top surface 12*u* to the bottom surface 12*d* is formed in a position where a feeding point 15 is disposed.

The antenna radiation electrode (radiation element) 14 is formed of a conductive film and formed on the top surface 12*u* of the dielectric substrate 12. The antenna radiation electrode (radiation element) 14 has a substantially square shape. The antenna radiation electrode (radiation element) 14 is formed, for example, by a silver-pattern printing method.

The ground electrode (ground conductor) 16 is formed of a conductive film and formed on the bottom surface 12*d* of the dielectric substrate 12. The ground electrode (ground conductor) 16 has a ground hole 16*a* being substantially concentric with the substrate hole 12*a* and having a larger diameter than that of the substrate hole 12*a*.

The feeding point 15 is provided at a position shifted in an x-direction and a y-direction from the center of the antenna radiation electrode 14. The feeding point 15 is connected to one end 18*a* of the feeding pin 18. The feeding pin 18 is extended downwardly through the substrate hole 12*a* and the ground hole 16*a* at a distance from the ground electrode (ground conductor) 16.

In the related-art first patch antenna 10, solder is used as the feeding point 15. For this reason, the feeding point 15 has a convex shape protruding upwardly from the main surface of the radiation electrode 14. That is, as shown in FIG. 3, the patch antenna 10 has a height H1 from the ground electrode 16 to the feeding point 15.

As shown in FIG. 4, as a feeding pin, there was also proposed the related-art second patch antenna 10A in which a rivet pin 18A having a head portion 181 provided at one end 18*a* thereof and a rod-shaped body portion 182 extending from the one end 18*a* thereof to the other end 18*b* thereof are used. In the related-art second patch antenna 10A, the head portion 181 of the rivet pin 18A is connected to the antenna radiation electrode 14 by soldering while the head portion 181 of the rivet pin 18A protrudes on the main surface of the antenna radiation electrode 14. For this reason, the connected part becomes the feeding point 15 and has a convex shape. That is, the patch antenna 10A shown in FIG. 4 has a height H2 from the ground electrode 16 to the feeding point 15. The height H2 is larger than the height H1 (H2>H1).

In addition, as shown in FIG. 5, in the related-art third patch antenna 10B, a circular antenna radiation electrode (radiation element) 14A is used instead of the square antenna radiation electrode (radiation element) 14.

A surface-mounting patch antenna in which the feeding pin does not pass through the mounting substrate and devices can be mounted on the surface of the mounting substrate was proposed (e.g., see Japanese Patent Publication No. 2005-260875A). In the surface-mounting patch antenna disclosed in Patent Document 2, a concave portion being substantially concentric with a substrate hole and having an inner diameter lager than the diameter of the substrate hole is formed on the back surface of a dielectric substrate. The other end of a feeding pin is formed in the substantially same plane with an exposure surface of a ground electrode provided on the back surface of the dielectric substrate.

As disclosed in the Japanese Patent Publication No. 2005-110198A, when the patch antenna is provided in the cover, it is required that the space for mounting the patch antenna is reduced as small as possible. Accordingly, it is very effective to reduce the height of the patch antenna.

However, in the related-art patch antennas 10, 10A, and 10B inclusive of the patch antenna disclosed in the Japanese Patent Publication No. 2005-260875A, since the feeding points 15 protrude relatively high from the main surfaces of the antenna radiation electrodes (radiation element) 14 and 14A in the convex shape, it is restricted to reduce the heights H1 and H2 of the patch antenna 10, 10A, and 10B.

SUMMARY

It is therefore an object of the invention to provide a patch antenna of which the height is reducible by decreasing the size of the convex shape at the feeding point as small as possible.

In order to achieve the above object, according to a first aspect of the invention, there is provided a patch antenna comprising:

a dielectric substrate, having a first face which is formed with a cavity, and a second face opposite to the first face, the dielectric substrate formed with a substrate hole which connects the cavity and the second face;

an antenna radiation electrode, comprised of a conductive film and formed on the first face of the dielectric substrate;

a ground electrode, comprised of a conductive film, formed on the second face of the dielectric substrate and formed with a ground hole which is substantially concentric with the substrate hole and has a diameter larger than that of the substrate hole; and a feeding pin, one end of which is connected to the antenna radiation electrode and the other end of which is extended toward the second face of the dielectric substrate through the substrate hole and the ground hole.

In the patch antenna according to the first aspect of the invention, the cavity may be substantially concentric with the substrate hole. The feeding pin may include a head portion provided at the one end and a rod-shaped body portion extending from the one end to the other end. In this case, the head portion is buried in the cavity.

In the patch antenna according to the first aspect of the invention, the dielectric substrate may have a substantially rectangular parallelepiped shape. The dielectric substrate may be comprised of a ceramic material. The antenna radiation electrode may be comprised of a silver pattern printed on the first face of the dielectric substrate. The antenna radiation electrode may have a substantially square shape. Instead, the antenna radiation electrode may have a substantially circular shape. The patch antenna may be an SDARS antenna operable to receive a radio wave transmitted from an SDARS satellite and may be a GPS antenna operable to receive a radio wave transmitted from a GPS satellite.

According to a second aspect of the invention, there is provided a patch antenna comprising:

a dielectric substrate, having a first face which is formed with a first cavity, and a second face opposite to the first face and formed with a second cavity, the dielectric substrate formed with a substrate hole which connects the first cavity and the second cavity;

an antenna radiation electrode, comprised of a conductive film and formed on the first face of the dielectric substrate;

a ground electrode, comprised of a conductive film and formed on the second face of the dielectric substrate; and a feeding pin, one end of which is connected to the antenna radiation electrode and the other end of which is extended toward the second face of the dielectric substrate through the substrate hole and the ground hole.

In the patch antenna according to the second aspect of the invention, the first cavity and the second cavity may be substantially concentric with the substrate hole and the first cavity may have the same shape as the second cavity. The feeding pin may include a head portion provided at the one end and a rod-shaped body portion extending from the one end to the other end. In this case, the head portion is buried in the first cavity.

In the patch antenna according to the second aspect of the invention, the dielectric substrate may have a substantially rectangular parallelepiped shape. The dielectric substrate may be comprised of a ceramic material. The antenna radiation electrode may be comprised of a silver pattern printed on the first face of the dielectric substrate. The antenna radiation electrode may have a substantially square shape. Instead, the antenna radiation electrode may have a substantially circular shape. The patch antenna may be an SDARS antenna operable to receive a radio wave transmitted from an SDARS satellite and may be a GPS antenna operable to receive a radio wave from a GPS satellite.

In the invention, since the cavity is formed on the first face of the dielectric substrate, the height of the protruding feeding point can be reduced. As a result, the height of the patch antenna can be reduced.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Hereinafter, embodiments of the invention will be described with reference to the drawings.

Figure 1:
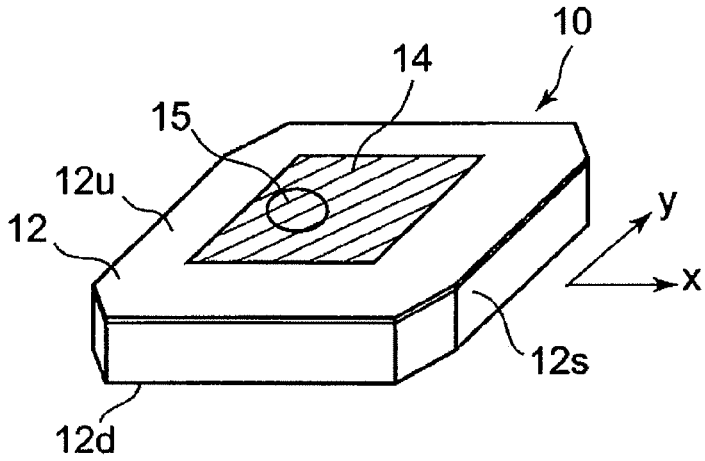
FIG. 1 is a perspective view of the related-art first patch antenna.
Figure 2C:
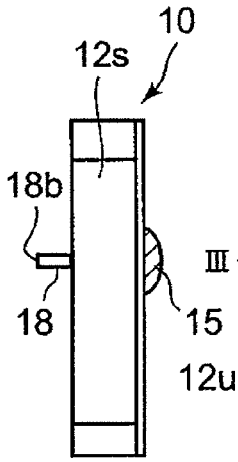
FIG. 2(C) is a left side view illustrating the patch antenna in FIG. 1.
Figure 2A:
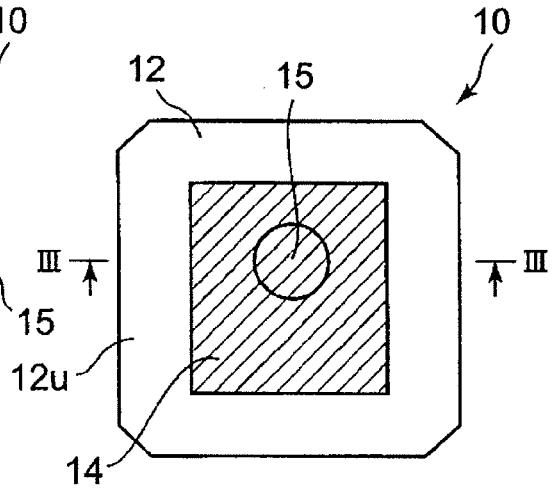
FIG. 2(A) is a plan view illustrating the patch antenna in FIG. 1.
Figure 2D:
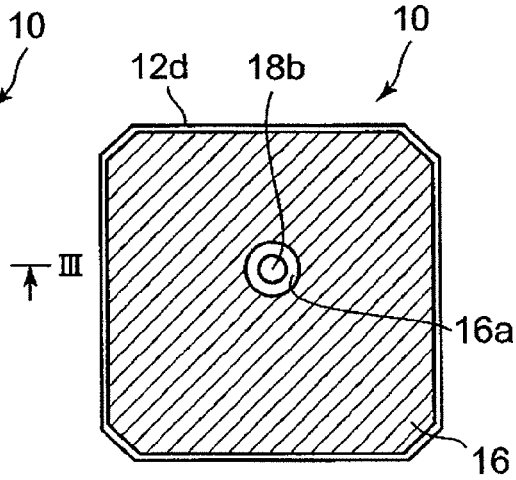
FIG. 2(D) is a bottom view illustrating the patch antenna in FIG. 1.
Figure 2B:
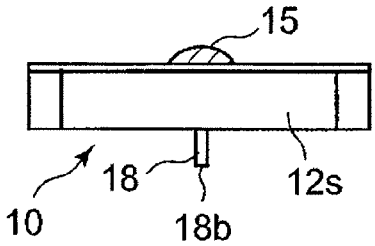
FIG. 2(B) is a front view illustrating the patch antenna in FIG. 1.
Figure 3:
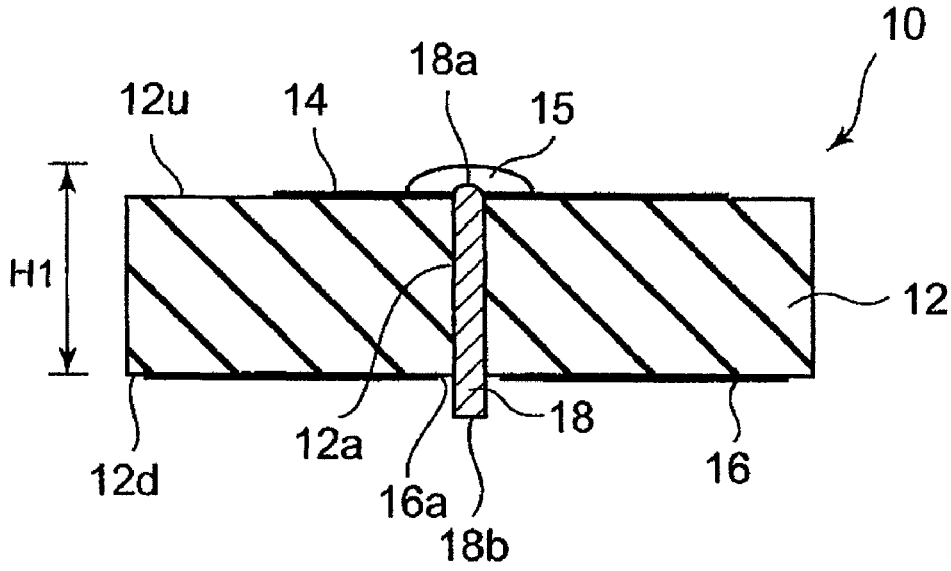
FIG. 3 is a cross-sectional view taken along Line III-III in FIG. 2(A)
Figure 6:
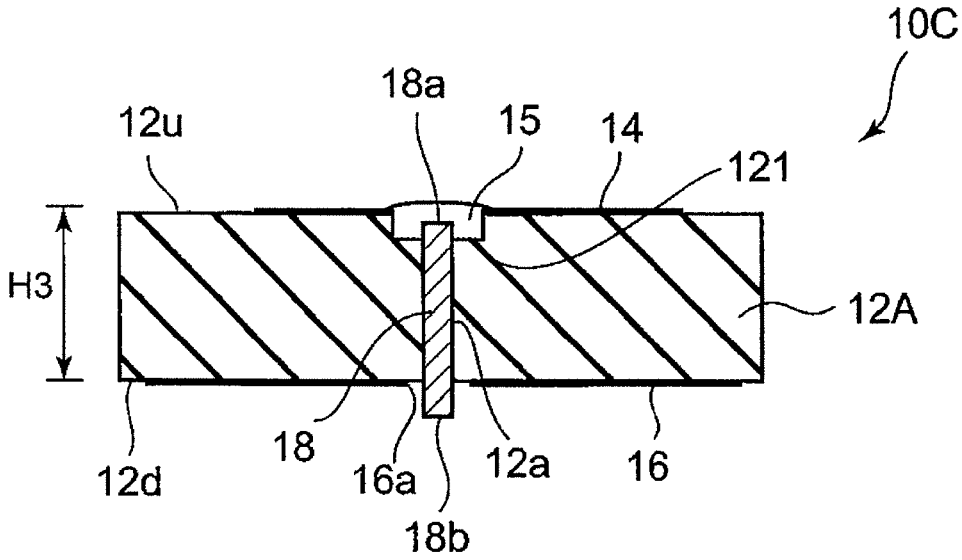
FIG. 6 is a cross-sectional view of a patch antenna according to a first embodiment of the invention.

A patch antenna 10C according to a first embodiment of the invention will be described with reference to FIG. 6. FIG. 6 is a cross-sectional view of the patch antenna 10C. The patch antenna 10C has the same configuration as the related-art first patch antenna 10 except that the configuration of the dielectric substrate is different from that shown in FIGS. 1 to 3 as described below. Accordingly, reference numeral 12A is given to the dielectric substrate. The same reference numerals are given to the constituents having the same functions as shown in FIGS. 1 to 3.

The exterior shape of the patch antenna 10C, as described below, is the same as that of the related-art first patch antenna 10 except that the extent how the feeding point 15 protrudes is different. Accordingly, hereinafter, the patch antenna 10C according to the first embodiment of the invention will be described with reference to FIGS. 1 and 2 in addition to FIG. 6.

The patch antenna 10C is used as an SDARS antenna operable to receive an electric wave (a radio wave) transmitted from an SDARS satellite or a GPS satellite antenna operable to receive an electric wave (a radio wave) transmitted from a GPS satellite.

The patch antenna 10C includes a dielectric substrate 12A having a substantially rectangular parallelepiped shape, an antenna radiation electrode (radiation element) 14, a ground electrode (ground conductor) 16, and a feeding pin 18.

The dielectric substrate 12A is made of, for example, high-permittivity ceramic materials consisting of barium titanate. The dielectric substrate 12A has a top surface (front surface) 12*u*, a bottom surface (back surface) 12*d* facing each other, and side surfaces 12*s*. The corners of the side surfaces 12*s* of the dielectric substrate 12A are chamfered. In the dielectric substrate 12A, a substrate hole 12*a* from the top surface 12*u* to the bottom surface 12*d* is formed in a position where a feeding point 15 is disposed.

The antenna radiation electrode (radiation element) 14 is formed of a conductive film and formed on the top surface 12*u* of the dielectric substrate 12A. The antenna radiation electrode (radiation element) 14 has a substantially square shape. The antenna radiation electrode (radiation element) 14 is formed, for example, by a silver-pattern printing method.

The ground electrode (ground conductor) 16 is formed of a conductive film and formed on the bottom surface 12*d* of the dielectric substrate 12A. The ground electrode (ground conductor) 16 has a ground hole 16*a* being substantially concentric with the substrate hole 12*a* and having a diameter larger than the diameter of the substrate hole 12*a*.

The feeding point 15 is provided at a position shifted in an x-direction and a y-direction from the center of the antenna radiation electrode 14. The feeding point 15 is connected to one end 18*a* of the feeding pin 18. The feeding pin 18 is extended through the substrate hole 12*a* and the ground hole 16*a* at a distance from the ground electrode (ground conductor) 16.

The dielectric substrate 12A has a cavity 121 which is formed in the top surface 12*u*, which is substantially concentric with the substrate hole 12*a*, and which has an inner diameter larger than the diameter of the substrate hole 12*a*. The cavity 121 is shaped in a mold used for manufacturing the dielectric substrate 12A. Accordingly, the cost of the dielectric substrate 12A does not increase in comparison with the relater-art dielectric substrate 12.

Meanwhile, solder is used as the feeding point 15. For this reason, the feeding point 15 has a convex portion protruding slightly up from the main surface of the antenna radiation electrode 14 with the feeding point 15 buried in the cavity 121. That is, as shown in FIG. 6, the patch antenna 10C has a height H3 from the ground electrode 16 to the feeding point 15.

Clearly, the height H3 is smaller than the height H1 of the relater-art first patch antenna 10 shown in FIG. 3 (H3<H1).

With such a configuration, since the cavity 121 for burying the solder is formed in the dielectric substrate 12A, the height H3 of the patch antenna 10C can be reduced smaller than the height H1 of the relater-art first patch antenna 10 shown in FIG. 3.

Figure 7:
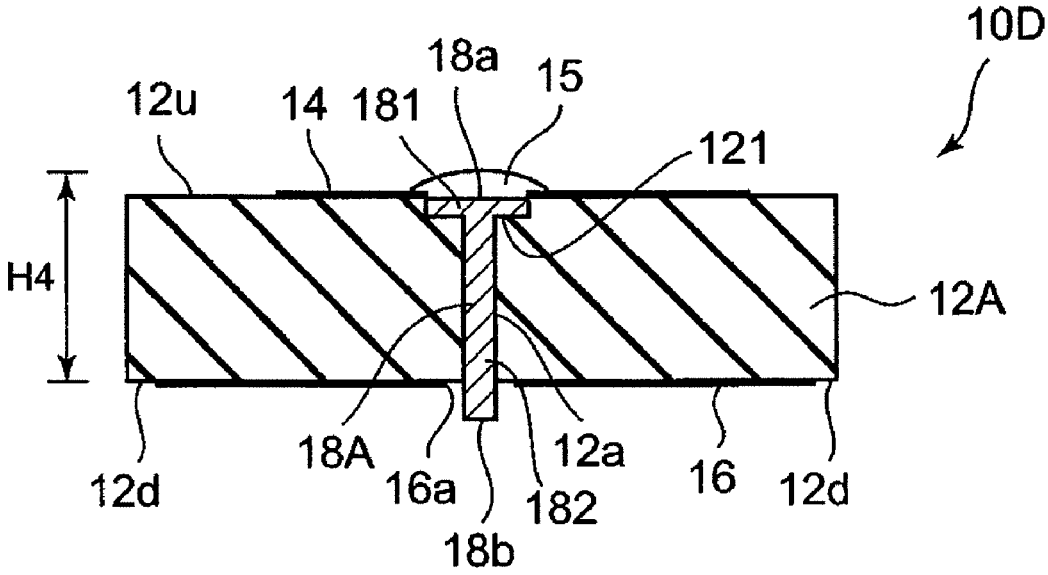
FIG. 7 is a cross-sectional view of a patch antenna according to a second embodiment of the invention.

A patch antenna 10D according to a second embodiment of the invention will be described with reference to FIG. 7. FIG. 7 is a cross-sectional view of the patch antenna 10D. The patch antenna 10D has the same configuration as that shown in FIG. 6, except that a structure of the feeding point is different from that shown in FIG. 6. That is, in FIG. 7, the rivet pin 18A shown in FIG. 4 is used as the feeding pin.

Figure 4:
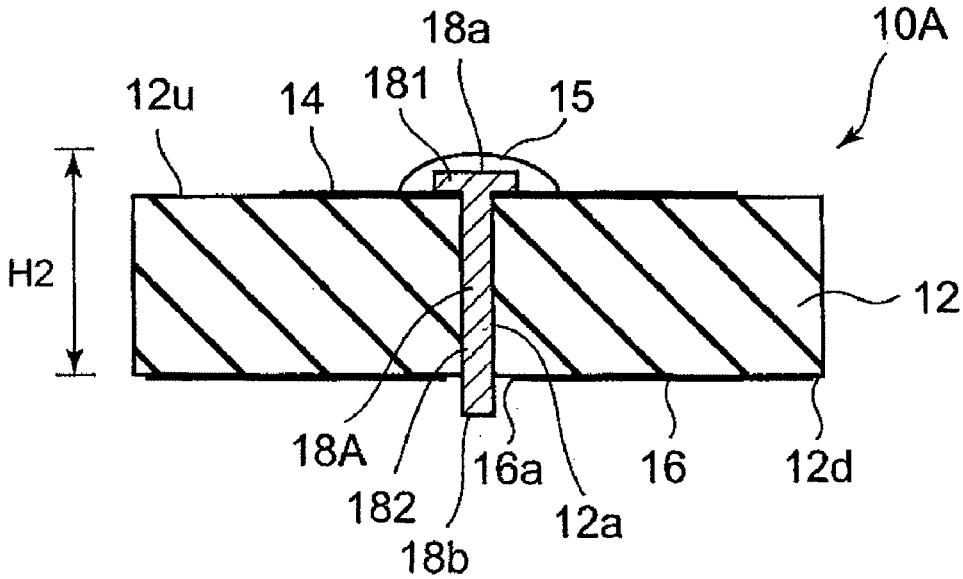
FIG. 4 is a cross-sectional view of the related-art second patch antenna.

In other words, the patch antenna 10D has the same configuration as that of the relater-art second patch antenna 10A shown in FIG. 4, except that the dielectric substrate 12A having the cavity 121 is used as a dielectric substrate.

The rivet pin 18A has a head portion 181 provided at one end 18*a* thereof and a rod-shaped body portion 182 extending from the one end 18*a* to the other end 18*b*.

As shown in FIG. 7, the head portion 181 of the rivet pin 18A is buried in the cavity 121. The head portion 181 of the rivet pin 18A is soldered to the antenna radiation electrode 14 in the state where the head portion 181 of the rivet pin 18A is buried in the cavity 121 of the dielectric substrate 12A as described above. For this reason, the feeding point 15 as the soldered part can protrude from the main surface of the antenna radiation electrode 14 lower than the relater-art second patch antenna 10A shown in FIG. 4. In other words, the feeding point 15 has a slightly convex shape. That is, the patch antenna 10D shown in FIG. 7 has a height H4 from the ground electrode 16 to the feeding point 15. The height H4 is smaller than the height H2 of the relater-art second patch antenna 10A shown in FIG. 4 (H4<H2).

With such a configuration, since the cavity 121 for burying the head portion 181 of the rivet pin 18A is formed in the dielectric substrate 12A, the height H4 of the patch antenna 10D can be reduced smaller than the height H2 of the relater-art second patch antenna 10A shown in FIG. 4.

Figure 8:
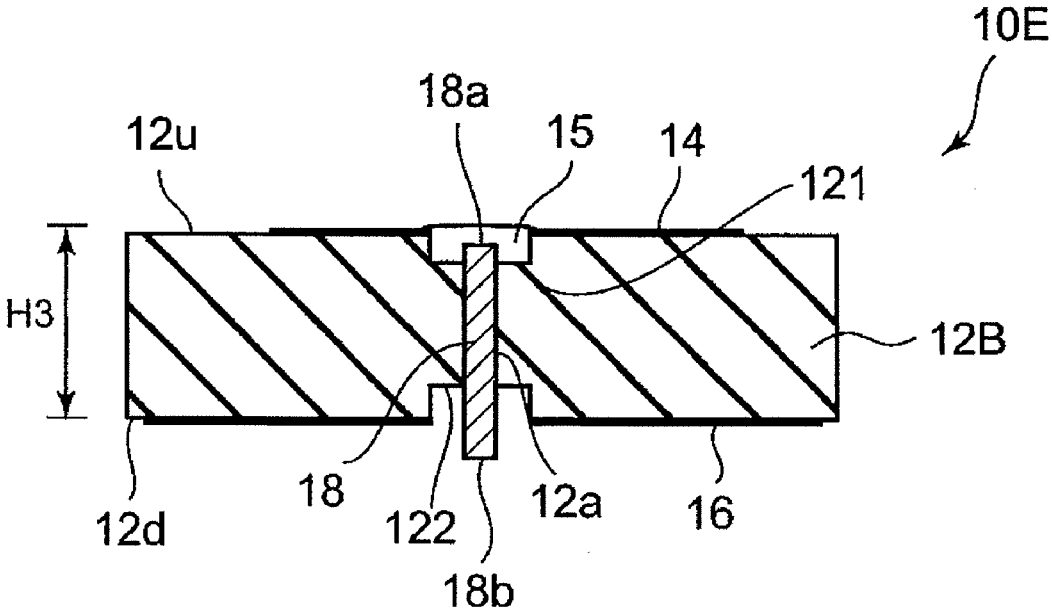
FIG. 8 is a cross-sectional view of a patch antenna according to a third embodiment of the invention.

A patch antenna 10E according to a third embodiment of the invention will be described with reference to FIG. 8. FIG. 8 is a cross-sectional view of the patch antenna 10E. The patch antenna 10E has the same configuration as that of the patch antenna 10C shown in FIG. 6 except that the configuration (structure) of the dielectric substrate is different from that shown in FIG. 6 as described below. Accordingly, reference numeral 12B is given to the dielectric substrate. Hereinafter, in order to simplify the description, only the parts different from the patch antenna 10C shown in FIG. 6 will be described.

The dielectric substrate 12B has the same configuration as that of dielectric substrate 12A shown in FIG. 6 other than the fact that the dielectric substrate 12B has the other cavity 122. In this embodiment, the cavity 121 is referred to as a first cavity and the other cavity 122 is referred to as a second cavity.

The first cavity 121, as described above, is formed in the top surface 12*u* of the dielectric substrate 12B, is substantially concentric with the substrate hole 12*a*, and has the inner diameter larger than the diameter of the substrate hole 12*a*. The second cavity 122 is formed in the bottom surface 12*d* of the dielectric substrate 12B, is opposed to the first cavity 121, and has the same shape as that of the first cavity 121.

Since the top surface (front surface) 12*u* and the bottom surface (back surface) 12*d* of the dielectric substrate 12B with such a structure have all the same shape, the number of management and process can be reduced in comparison with the dielectric substrate 12A shown in FIG. 6. In other words, when the antenna radiation electrode 14 and the ground electrode 16 are formed, it is not required to check the front and back of the dielectric substrate 12B. Accordingly, mistakes in manufacture can be reduced.

The inventor has confirmed that there is no problem in performance of the dielectric substrate even when the cavities 121 and 122 are formed in both surfaces 12*u* and 12*d* of the dielectric substrate 12B as described above.

Further, in the patch antenna 10E with such a structure, the first cavity 121 for burying the solder in the dielectric substrate 12B is formed in the same way as the patch antenna 10C shown in FIG. 6. Accordingly, the height H3 of the patch antenna 10E can be reduced smaller than the height H1 of the relater-art first patch antenna 10 shown in FIG. 3.

Figure 9:
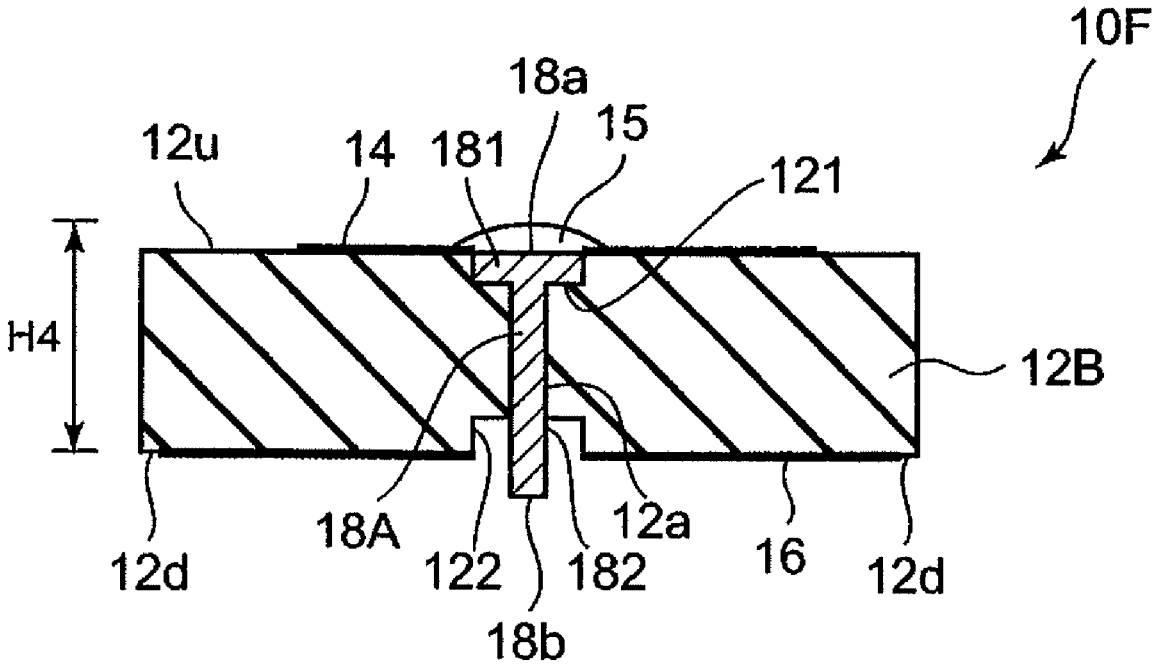
FIG. 9 is a cross-sectional view of a patch antenna according to a fourth embodiment of the invention.

A patch antenna 10F according to a fourth embodiment of the invention will be described with reference to FIG. 9. FIG. 9 is a cross-sectional view of the patch antenna 10. The patch antenna 10F shown in FIG. 8 has the same configuration as the patch antenna 10D shown in FIG. 7, except that the dielectric substrate 12B shown in FIG. 8 is used as the dielectric substrate.

Further, in the patch antenna 10F with such a structure, since the first cavity 121 for burying the head portion 181 of the rivet pin 18A is formed in the dielectric substrate 12B in the same way as the patch antenna 10D shown in FIG. 7, the height H4 of the patch antenna 10F can be reduced smaller than the height H2 of the relater-art second patch antenna 10A shown in FIG. 4.

Figure 5:
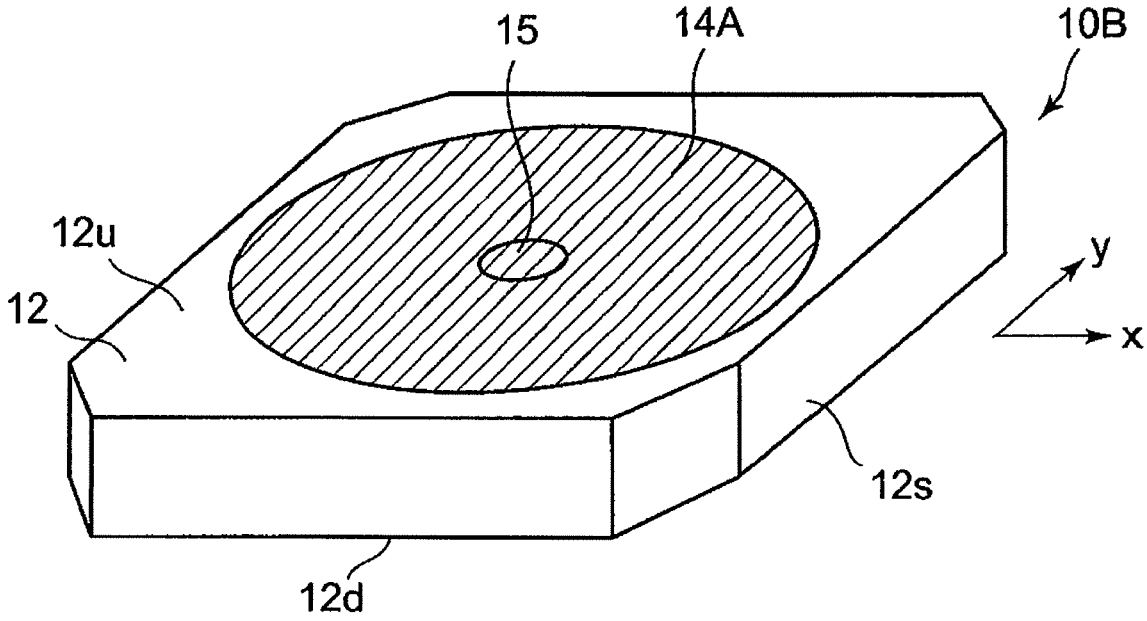
FIG. 5 is a perspective view of the related-art third patch antenna.

While the preferred embodiments according to the invention have been described above, the invention is not limited to the above-described embodiments. For example, the square antenna radiation electrode in the above-mentioned embodiments may be circular in shape as shown in FIG. 5. The materials of the dielectric substrate are not limited to the ceramic materials, but the dielectric substrate may be made of resin materials. In addition, the patch antenna according to the invention is suitable for the GPS antenna or the SDARS antenna, but is not limited thereto and is applicable to any mobile-communication antenna for receiving any other satellite wave and terrestrial wave.

What is claimed is:

1. A patch antenna comprising:

a dielectric substrate, having a first face which is formed with a cavity, and a second face opposite to the first face, the dielectric substrate formed with a substrate hole which connects the cavity and the second face;

an antenna radiation electrode, comprised of a conductive film and formed on the first face of the dielectric substrate;

a ground electrode, comprised of a conductive film, formed on the second face of the dielectric substrate and formed with a ground hole which is substantially concentric with the substrate hole and has a diameter larger than that of the substrate hole; and a feeding pin, one end of which is connected to the antenna radiation electrode and the other end of which is extended toward the second face of the dielectric substrate through the substrate hole and the ground hole, wherein the feeding pin includes a head portion provided at the one end and a rod-shaped body portion extending from the one end to the other end; and the head portion is buried in the cavity, wherein the cavity is filled with solder, and wherein the solder has a convex portion which is protruded from the first surface and is electrically connected to the antenna radiation electrode.

2. The patch antenna as set forth in claim 1, wherein the cavity is substantially concentric with the substrate hole.

3. The patch antenna as set forth in claim 1, wherein the dielectric substrate has a substantially rectangular parallelepiped shape.

4. The patch antenna as set forth in claim 1, wherein the dielectric substrate is comprised of a ceramic material.

5. The patch antenna as set forth in claim 1, wherein the antenna radiation electrode is comprised of a silver pattern printed on the first face.

6. The patch antenna as set forth in claim 1, wherein the antenna radiation electrode has a substantially square shape.

7. The patch antenna as set forth in claim 1, wherein the antenna radiation electrode has a substantially circular shape.

8. The patch antenna as set forth in claim 1, wherein the patch antenna is an SDARS antenna operable to receive a radio wave transmitted from an SDARS satellite.

9. The patch antenna as set forth in claim 1, wherein the patch antenna is a GPS antenna operable to receive a radio wave transmitted from a GPS satellite.

10. A patch antenna comprising:

a dielectric substrate, having a first face which is formed with a first cavity, and a second face opposite to the first face and formed with a second cavity, the dielectric substrate formed with a substrate hole which connects the first cavity and the second cavity;

an antenna radiation electrode, comprised of a conductive film and formed on the first face of the dielectric substrate;

a ground electrode, comprised of a conductive film and formed on the second face of the dielectric substrate; and a feeding pin, one end of which is connected to the antenna radiation electrode and the other end of which is extended toward the second face of the dielectric substrate through the substrate hole and the ground hole, wherein the feeding pin includes a head portion provided at the one end and a rod-shaped body portion extending from the one end to the other end; and the head portion is buried in the cavity, wherein the first cavity is filled with solder, and wherein the solder has a convex portion which is protruded from the first surface and is electrically connected to the antenna radiation electrode.

11. The patch antenna as set forth in claim 10, wherein:

the first cavity and the second cavity are substantially concentric with the substrate hole; and the first cavity has the same shape as the second cavity.

12. The patch antenna as set forth in claim 10, wherein the dielectric substrate has a substantially rectangular parallelepiped shape.

13. The patch antenna as set forth in claim 10, wherein the dielectric substrate is comprised of a ceramic material.

14. The patch antenna as set forth in claim 10, wherein the antenna radiation electrode is comprised of a silver pattern printed on the first face.

15. The patch antenna as set forth in claim 10, wherein the antenna radiation electrode has a substantially square shape.

16. The patch antenna as set forth in claim 10, wherein the antenna radiation electrode has a substantially circular shape.

17. The patch antenna as set forth in claim 10, wherein the patch antenna is an SDARS antenna operable to receive a radio wave transmitted from an SDARS satellite.

18. The patch antenna as set forth in claim 10, wherein the patch antenna is a GPS antenna operable to receive a radio wave transmitted from a GPS satellite.

* * * * *